US006142225A

United States Patent [19]

McCorry et al.

[11] Patent Number: 6,142,225

[45] Date of Patent: Nov. 7, 2000

[54] SELECTIVE MONO BORE DIVERTER SYSTEM

[75] Inventors: Mark McCorry; David George Forsyth; Robert C. Smith; David Cameron, all of Aberdeen, United Kingdom

[73] Assignee: Baker Hughes Incorporated, Houston, Tex.

[21] Appl. No.: 08/983,597

[22] PCT Filed: Apr. 30, 1997

[86] PCT No.: PCT/US97/07278

§ 371 Date: Dec. 29, 1997

§ 102(e) Date: Dec. 29, 1997

[87] PCT Pub. No.: WO97/41331

PCT Pub. Date: Nov. 6, 1997

[30] Foreign Application Priority Data

May 1, 1996 [GB] United Kingdom ..... 96 09153

[51] Int. Cl.[7] ..... E21B 7/06

[52] U.S. Cl. ..... 166/117.6; 166/50; 166/382

[58] Field of Search ..... 166/117.5, 117.6, 166/382, 381, 313, 50

[56] References Cited

U.S. PATENT DOCUMENTS

| | | | |
|---|---|---|---|
| 4,807,704 | 2/1989 | Hsu et al. | 166/313 |
| 5,311,936 | 5/1994 | McNair et al. | 166/50 |
| 5,467,819 | 11/1995 | Braddick | 166/117.6 |
| 5,474,131 | 12/1995 | Jordan, Jr. et al. | 166/313 |
| 5,915,474 | 6/1999 | Buytaert et al. | 166/50 |

*Primary Examiner*—David Bagnell
*Assistant Examiner*—Zakiya Walker
*Attorney, Agent, or Firm*—Cantor Colburn LLP

[57] ABSTRACT

The invention provides a selective system of placing a guide stock into a wellbore by braided line, coil tubing or drill pipe. The device facilitates selective intervention by providing a selective orientation key an angular relationship to the lateral through a system of selective keys and dogs allowing the diverter of the guide stock to be aligned at any desired angle with the orientation sub. The orientation sub includes a key for picking up on a helical slot in the packer to rotate the assembly and a set of selectively profiled dogs to engage a selected packer and halt downhole movement of the device.

12 Claims, 27 Drawing Sheets

SELECTIVE MONO BORE DIVERTER SYSTEM

BACKGROUND OF THE INVENTION

1. Field of the Invention

The invention relates to the field of oil well intervention. More particularly, the invention relates to a system of providing selective access to particular laterals for intervention wherein angle and orientation of the intervention string is ensured.

2. Prior Art

As one of skill in the art will undoubtedly appreciate one prior art method for intervening in a lateral was to simply measure the distance of pipe lowered into the hole. While this method has been used for many years, it has always been a difficult one because of the extreme distances involved. For example, where 100 feet of pipe is laid, a variance of two inches does not appear to be significant. This, however, is not the case when twenty thousand feet of pipe is contemplated. In keeping with the example, the two inches has become 400 feet. A distance off the mark of this magnitude can significantly hinder the working of the well. Therefore it is of interest to the industry to reduce variance to a minimum to maintain accuracy even at large depths.

It will be appreciated that spring loaded dogs are not new to the art and have been used for various purposes including positioning of tools however the combination of features that make the invention valuable have not before been contemplated.

SUMMARY OF THE INVENTION

The above-discussed and other drawbacks and deficiencies of the prior art are overcome or alleviated by the monobore diverter system of the invention.

The invention is a system comprising three distinct sections including: 1) an orientation device to align a guide stock angularly with a bore of a packer; 2) an adjustment sub adjustable prior to running the assembly which ensures the desired angular position of the guide stock relative to the alignment sub of the packer; and 3), if a six inch bore is desired, a centralization sub to provide centralization of the guide stock within the well bore. Where there is no requirement for a six inch bore the centralization sub is not necessary and only a spacer long enough to retain the top of the guide stock in the tail pipe of the packer will be necessary.

With respect to the orientation device, the device and system of the invention further comprise a collapsible key and a series of selectively profiled dogs. As will be apparent to one of skill in the art from a review of the drawings hereof, the key is picked up in a helical slot to rotate the device of the invention to the desired and predetermined orientation while the dogs engage a profile complimentary thereto to prevent further downhole movement of the device. Because of the selective profile, the device of the invention can be essentially, coded to seek out the correct packer by skipping over any nonconforming packers. It is important to note that the original deployment of packers must consider the likelihood of the dogs engaging the incorrect packer due to a larger profile than the dogs. Packer profiles should be set accordingly to avoid the problem. The key of the device, when it reaches the intended packer picks up on a helical slot in the packer and begins to spin the arrangement into the orientation desired. The helical slot ends with an alignment profile in the packer. Therefore, because the device of the invention provides a known orientation between the orientation sub and the guide stock, it is certain that the intervention string will penetrate the lateral as intended. When the dogs pick up on the selective profile downhole movement is halted and the dogs are locked in placed by a moveable internal mandrel. Where access to the bore of six inches is required, a centralization device is employed which comprises a set of arms normally held into the body of the tool by a reverse angled section constructed to facilitate such holding. The arms are not released until a shear pin is overcome. A garter spring is provided to assist in pulling the arms back to a position in which they are retained by the reverse angled section subsequent to being disengaged from the borehole. The arms may be driven out on an angled face when desired in order to centralize the device of the invention in the bore.

In another embodiment where tool runs intended do not employ tools with an OD of greater than 4.75 inches, the centralization sub is not necessary as noted above. Rather, the top of the guide stock is retained in the tailpipe of a packer above the chosen ML packer (commercially available from Baker Oil Tools in Houston, Tex.) in order to provide centralization, thus obviating the centralization sub for this embodiment.

Retrieval methods for both of the embodiments arc also disclosed.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 1A–1I are an extended view of one embodiment of the invention wherein a six inch bore is required and centralizing arms are illustrated;

FIGS. 3A–3K are an extended view of a second embodiment of the invention wherein a narrower access diameter is necessary and no centralizing arms are required.

DETAILED DESCRIPTION OF THE PREFERRED EMBODIMENT

Figure 1A:
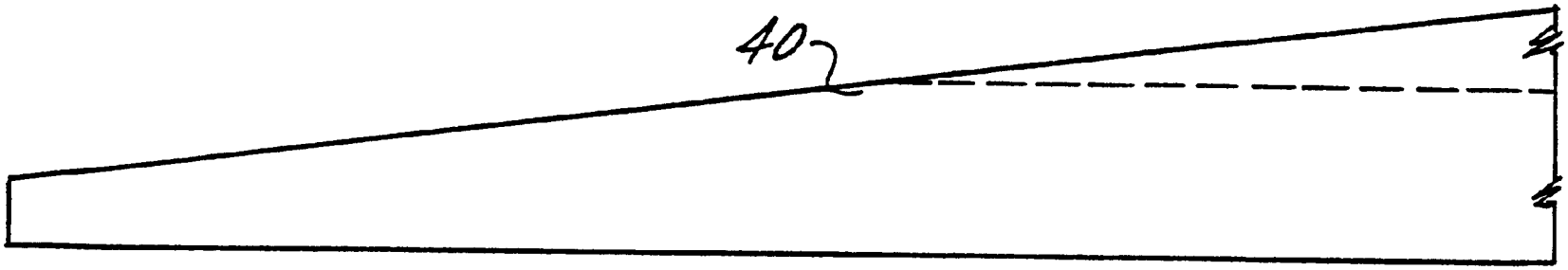
Figure 1B:
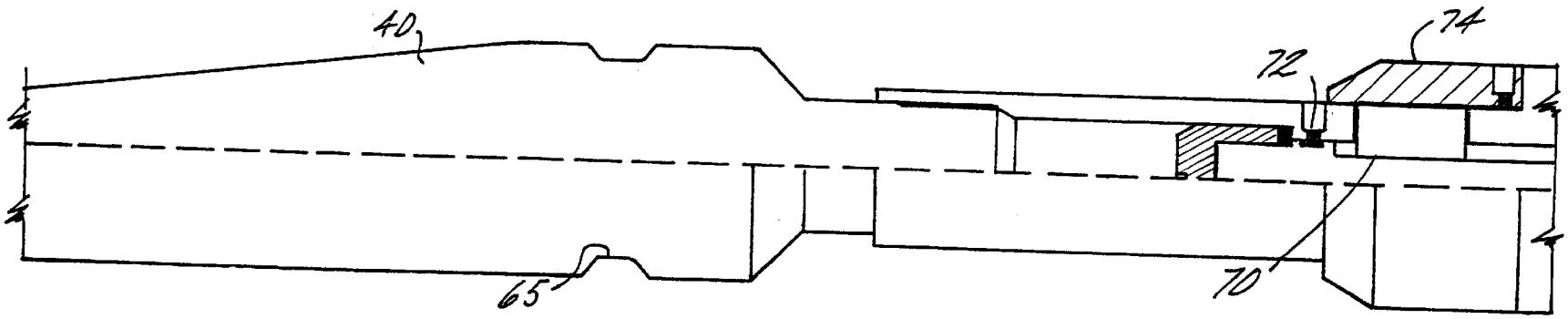
Figure 1C:
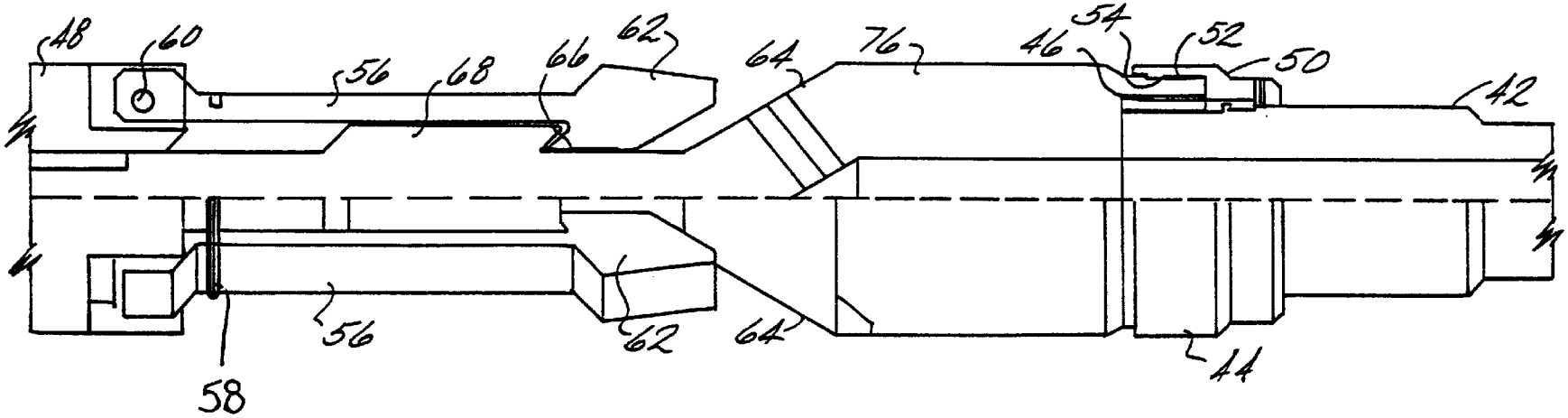
Figure 1D:
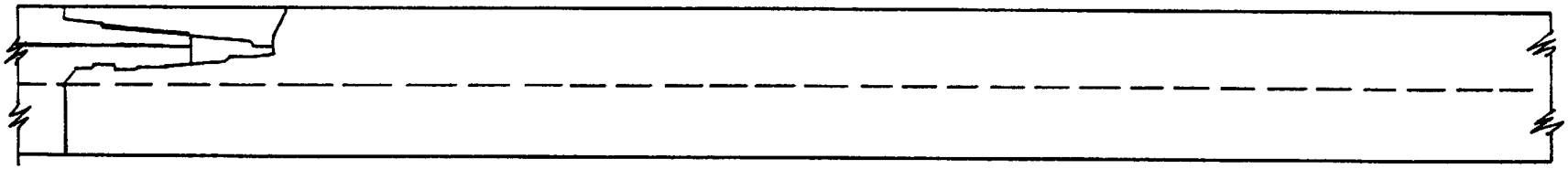
Figure 1E:
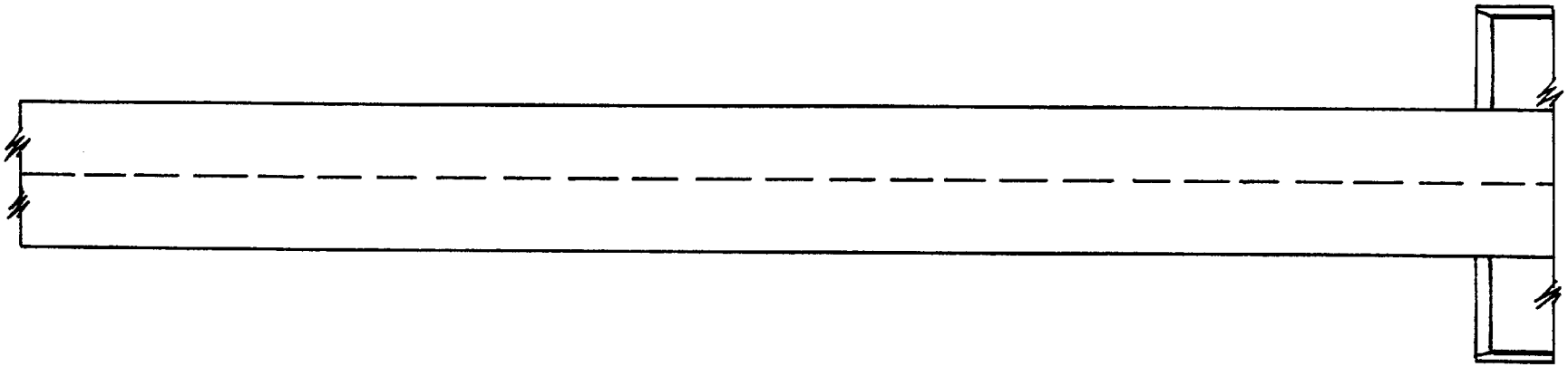
Figure 1F:
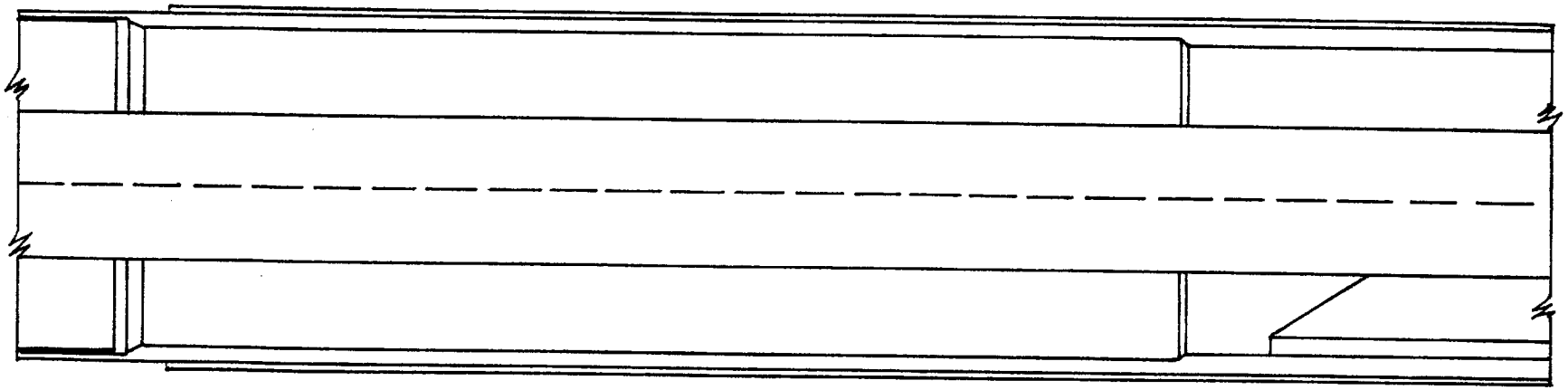
Figure 1G:
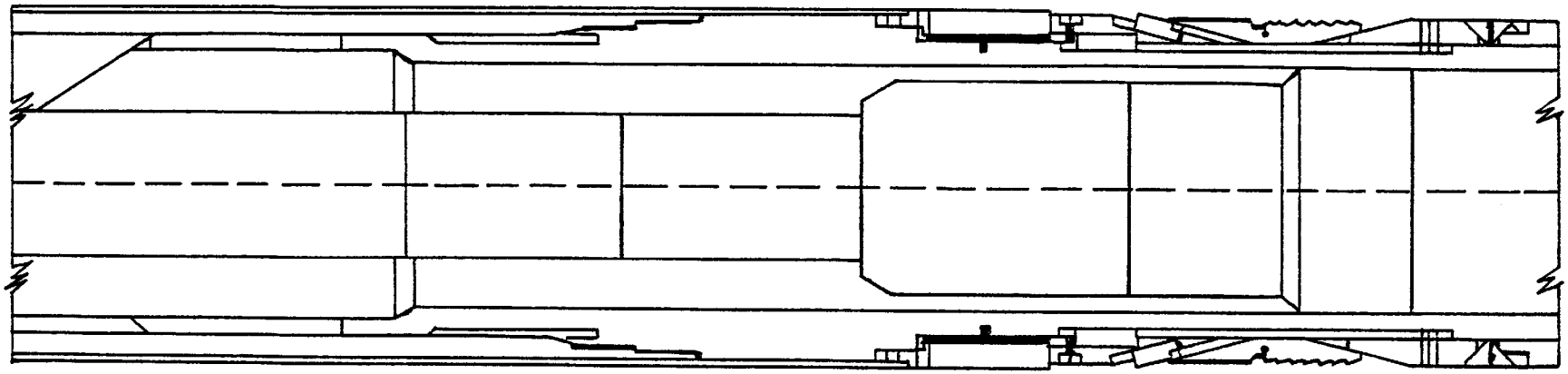
Figure 1H:
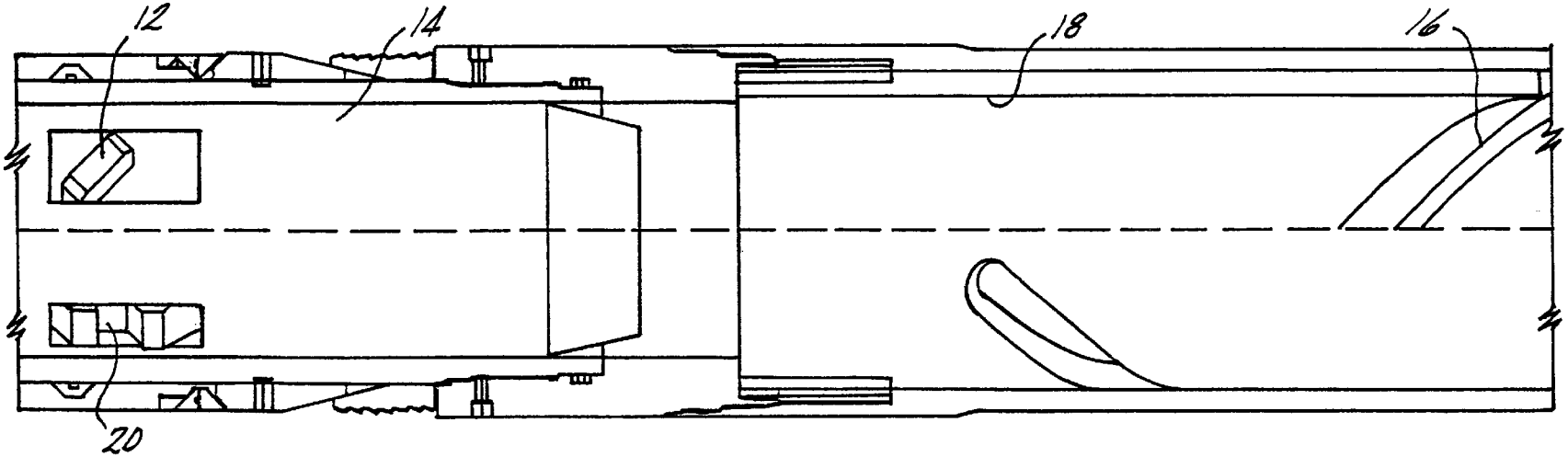
Figure 11:
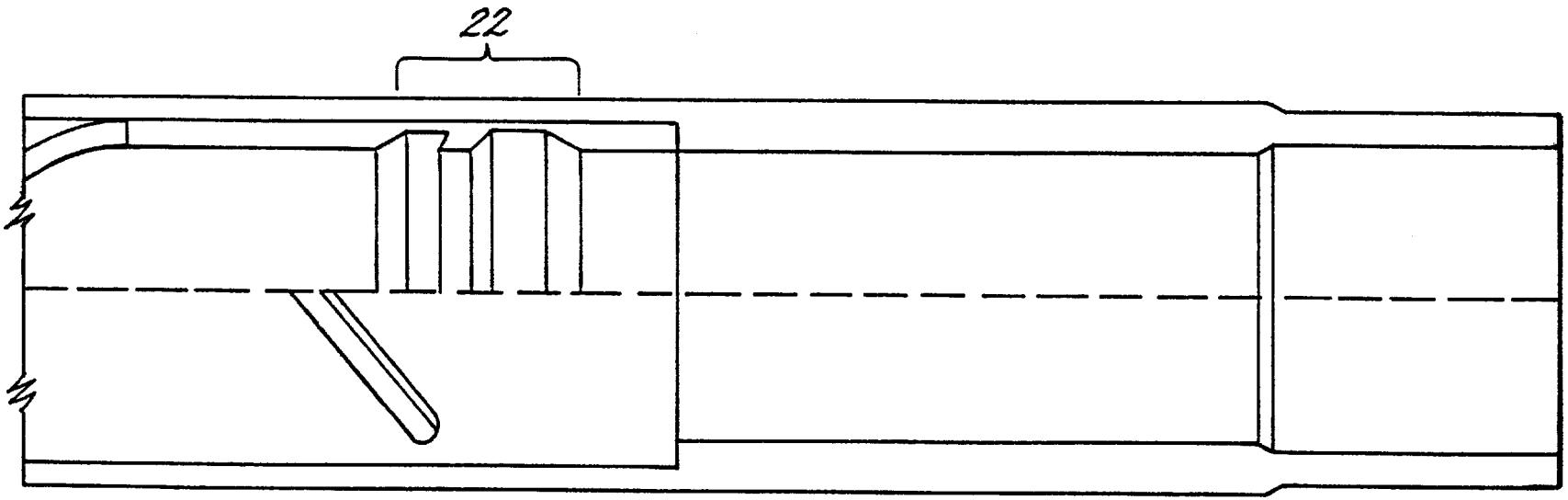

Referring to FIGS. 1A–1I generally, and to FIG. 1H specifically, spring key 12 is provided in the orientation sub 14 of the device at an angle complimentary to that of a helical slot 16 in the inner wall the previously installed ML packer. It should be noted that the packer was installed to provide an anchor for a whipstock which initially was employed to drill the lateral the rigger is now interested in reentering. This provides for an excellent anchor from which to stage the reentry of the lateral. Upon key 12 picking up on slot 16 the device of the invention is rotated into a known orientation by tracking in the slot while moving downhole. When the key has traveled to the lowest point of the slot 16 the position of the diverter relative to the whipstock alignment sub is known. Adjacent to the downhole end of helical slot 16 is a selective profile 22 which is different in each of the packers downhole. Dogs 20 carry a complimentary profile to only one of the selective profiles 22 in one of the downhole packers. If the dogs 20 do not match profile 22 in a particular packer, the device of the invention will skip past that packer and move on to a packer lower downhole. It should be appreciated that care must be taken in arranging packers downhole with the selective profiles 22 such that a dog will not misengage a profile 22 in the wrong packer simply because it is smaller than the opening in the profile. When the dog 20 does engage profile 22, downward movement of the device of the invention is stopped and the orientation of the device of the invention is known due to the engagement of key 12 in helical slot 16. It should be noted that both key 12 and dogs 20 are spring loaded and will extend outwardly to engage their respective intended targets only if sufficient space is available for them to do so (i.e. the profile is the complimentary one).

Figure 2A:
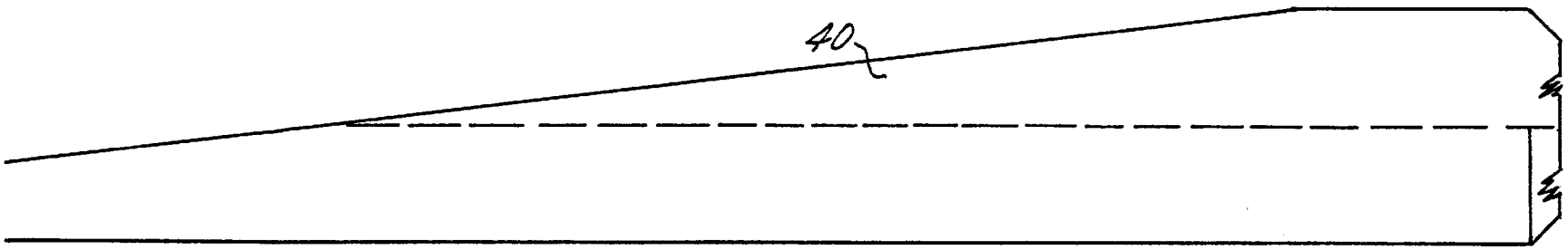
FIGS. 2A–2G are an extended view of the embodiment of FIG. 1 in the actuated position.
Figure 2B:
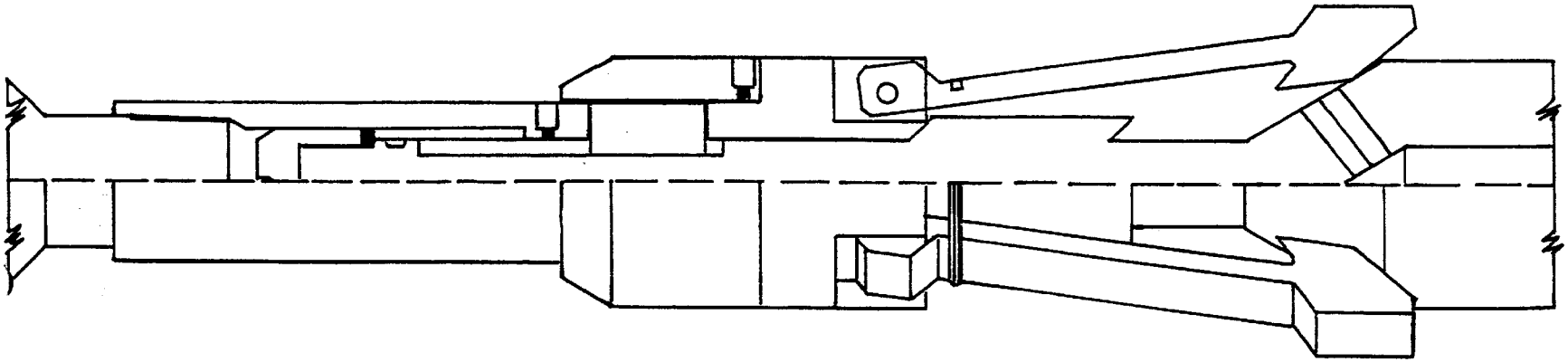
Figure 2C:
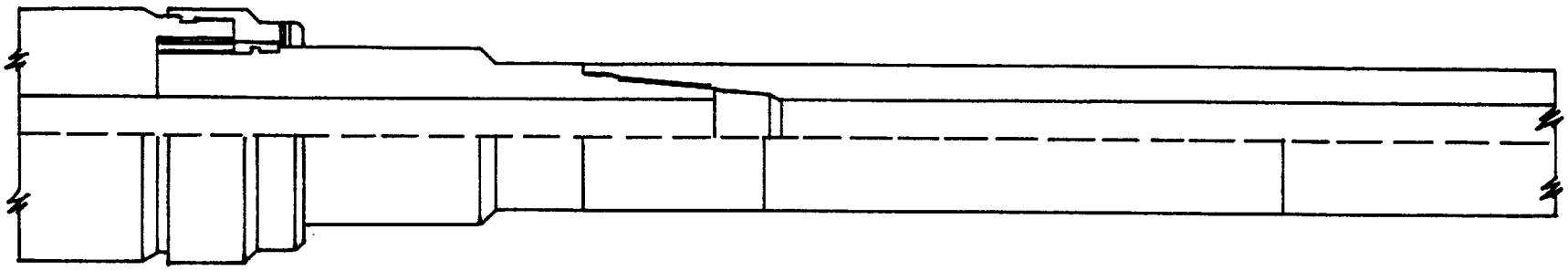
Figure 2D:
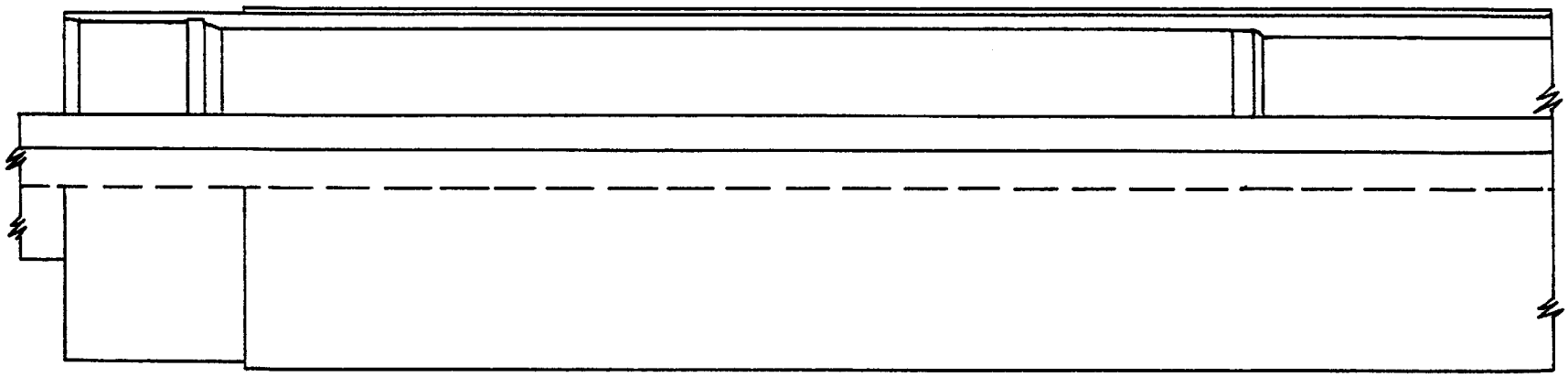
Figure 2E:
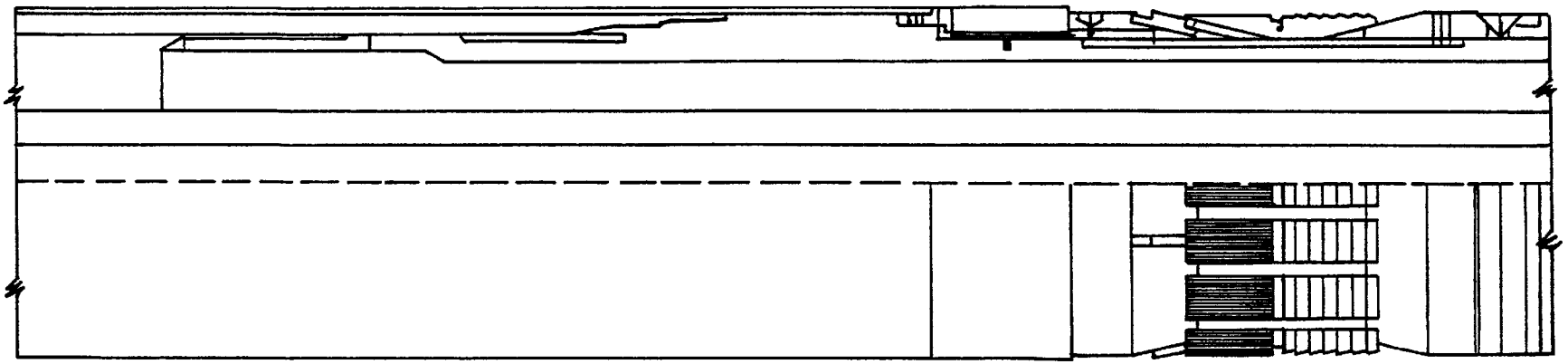
Figure 2F:
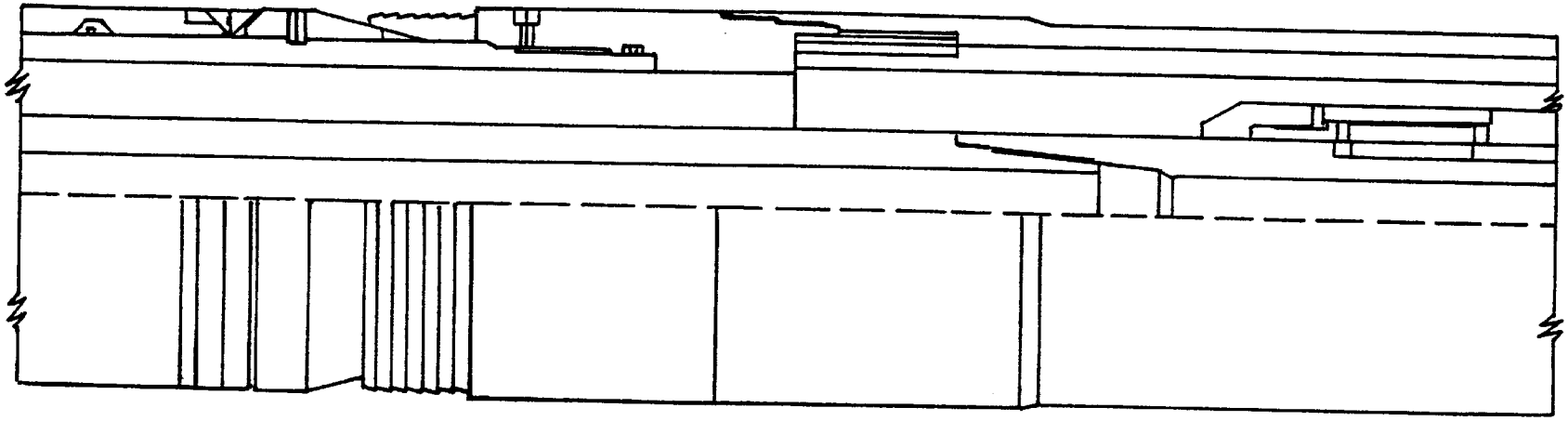
Figure 2G:
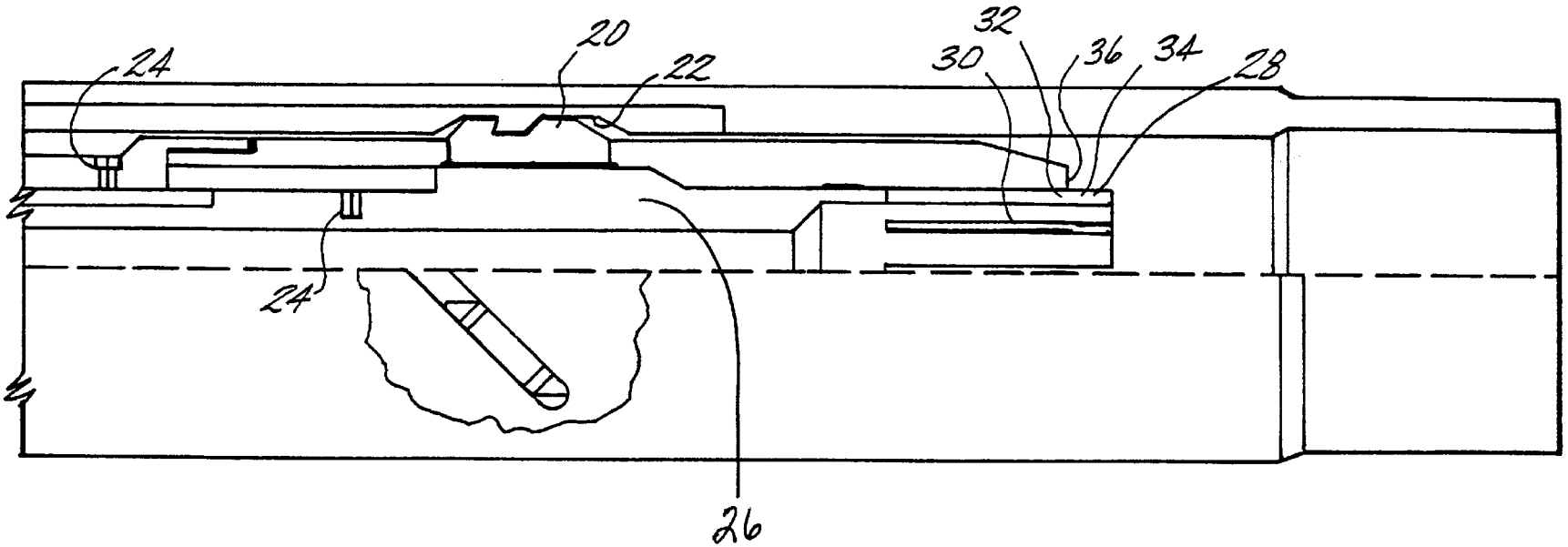
Figure 31:
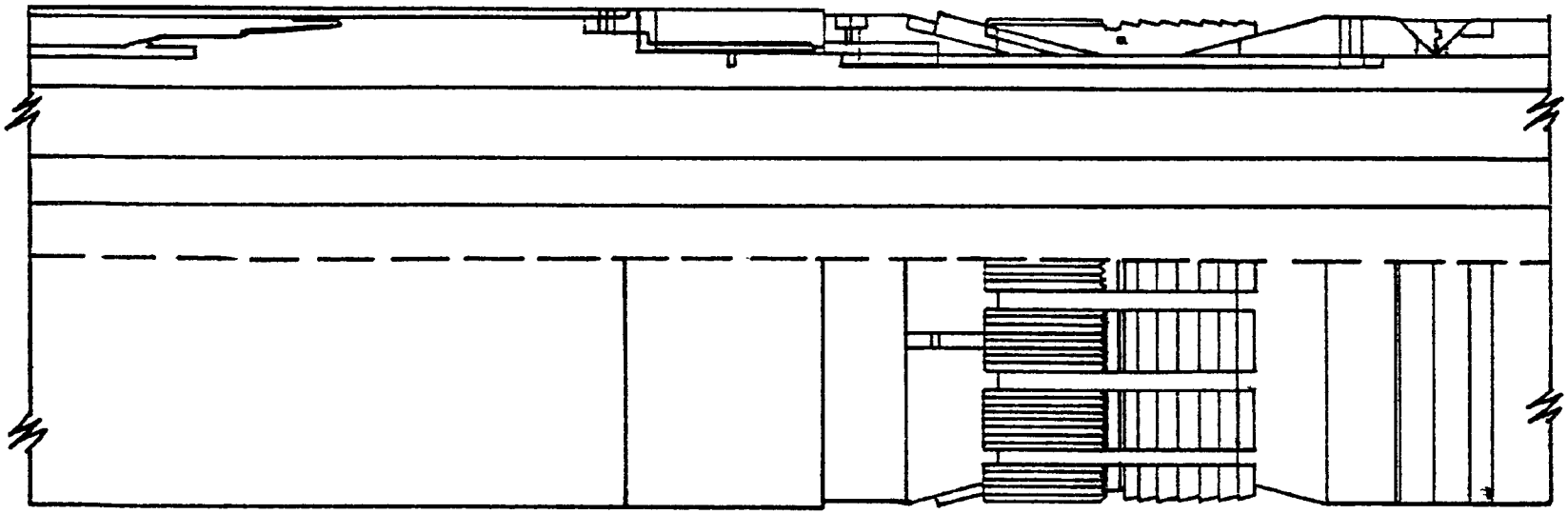

In order to ensure that dogs 20 remain securely engaged with profile 22, weight is slacked from the surface which shears pin 24 illustrated in the sheared position in FIG. 2G. Upon shearing of pin 24, mandrel 26 moves downhole to support dog 20 in engagement with selective profile 22. To prevent mandrel 26 from moving uphole and consequently disengaging the support for selective dog 20, a collet 28 is provided at the downhole extremity of mandrel 26, said collet having a plurality of slots 30 and fingers 32, the fingers having upstruck portions 34. Upon mandrel 26 moving downhole as described, fingers 32 spring outwardly leaving upstruck members 34 exposed to an abutting surface 36. This prevents the unintended movement of mandrel 26 uphole since, in general, forces downhole are not sufficient to deflect fingers 32 the necessary amount to disengage collet 28 from surface 36. It is possible, however, to intentionally disengage collet 28 from surface 36 by providing sufficient pull from the surface to collapse fingers 32 and thereby disengage support for selective dogs 20.

Referring to FIGS. 1B and 1C another important aspect of the device of the invention is illustrated. Since many different orientations are possible for laterals on a primary bore in the field, it is necessary to provide an adjustment sub which will allow orientation of the diverter 40 relative to the orientation sub to position the angled face of diverter 40 toward the lateral to be entered. For this purpose, a spline sub 42 is preferred. Spline sub 42 includes splines 44 complimentary to splines 46 on centralization sub 48 spline sub 42 and centralization sub 48 are rotated relative to one another until the desired angle is achieved. They are then slit into an engagement with one another and maintained in the desired position by spline retainer 50 which includes box thread 52 complimentary to pin thread 54 on centralization sub 48. Spline retainer 50 prevents the splines from becoming disengaged.

Moving uphole from spline sub 42, centralization sub 48 includes a plurality of centralization arms 56 which are maintained for the run-in of the tool in a position adjacent to the body of centralization sub 48. Arms 56 are maintained in such a position by reverse angled section 66. Arms 56 are articulated with centralization sub 48 through pin 60 at various points of the OD of the device. At the downhole end of arms 56 are contact members 62 which ride up inclined plane 64 forcing arms 56 outward and into contact with the casing of the primary bore. Member 62 furthermore includes reverse angled section 66 which hooks onto retainer projection 68 to assist in maintaining the arms in the stowed position subsequent to the garter spring 58 urging the arms back toward the member 62.

Actuation of arms 56 is accomplished by slacking weight to shear a second shear pin of this embodiment and allowing or urging the diverter to move downhole to push the arms onto the angled surface and thereby urge the same outwardly and into contact with the casing of the primary bore. Referring to FIGS. 1B and 1C, key 70 provides both torsional resistance and linear slideability of the external portion of centralization sub 48. Shear pin 72 is provided to prevent such movement prior to the desired time which is indicated by further slacking the string providing sufficient weight to shear the pin. Key 70 is retained by key retainer 74 to transmit torsional force to the components of the tool downhole.

As will now be appreciated by one of ordinary skill in the art, the tool is moved downhole until first the key 12 picks up on the helical slot 16. The tool is rotated as it moves further downhole. Providing that the dogs match the profile of the profile 22 they will engage the same preventing further movement downhole of the tool. Slacking of the tool string will shear a first shear pin allowing a mandrel to slide behind the dogs and therefore support them in the locked position. Subsequently, a further slacking of the string will shear a second shear pin 72 allowing centralization sub 48 to slide downhole over the mandrel 76 and push centering arms outward on surfaces 64 to centralize the diverter 40 in the bore for diverting a subsequent tool intended to be inserted in the lateral. The tool is illustrated in the actuated position in extended FIG. 2.

Figure 3A:
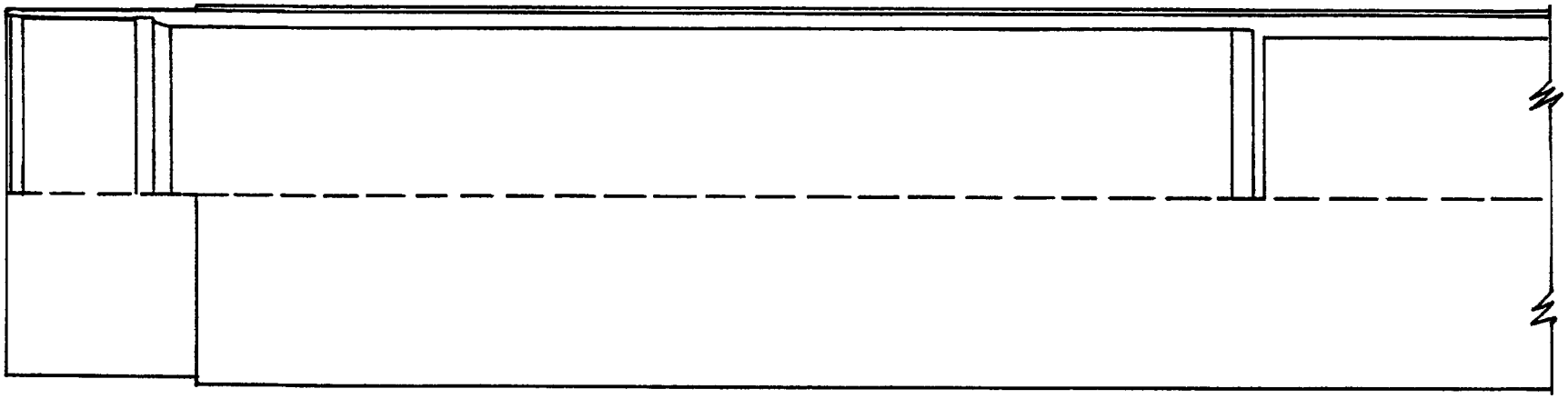
Figure 3B:
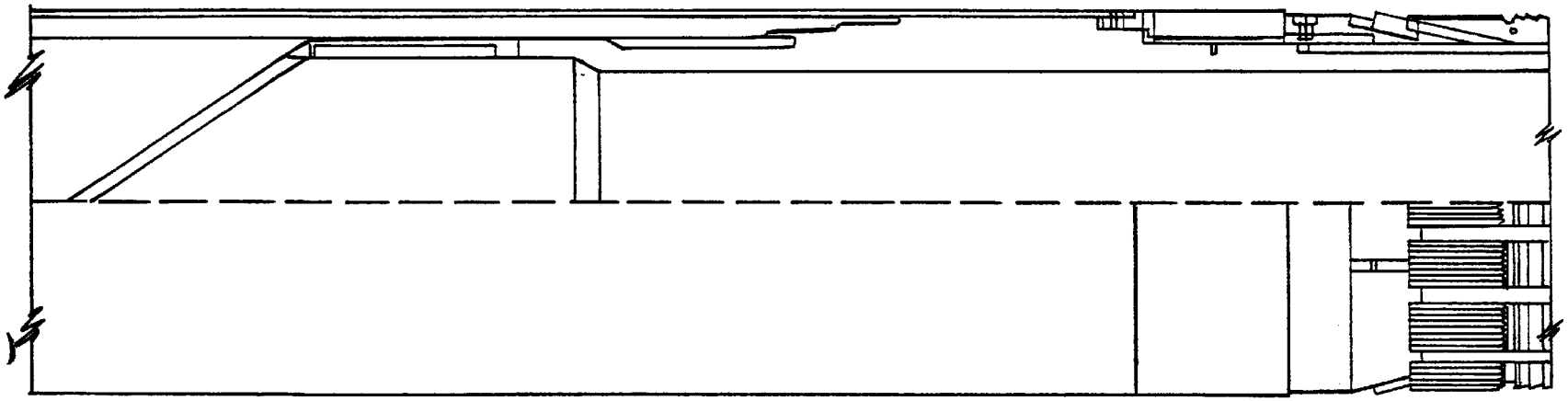
Figure 3C:
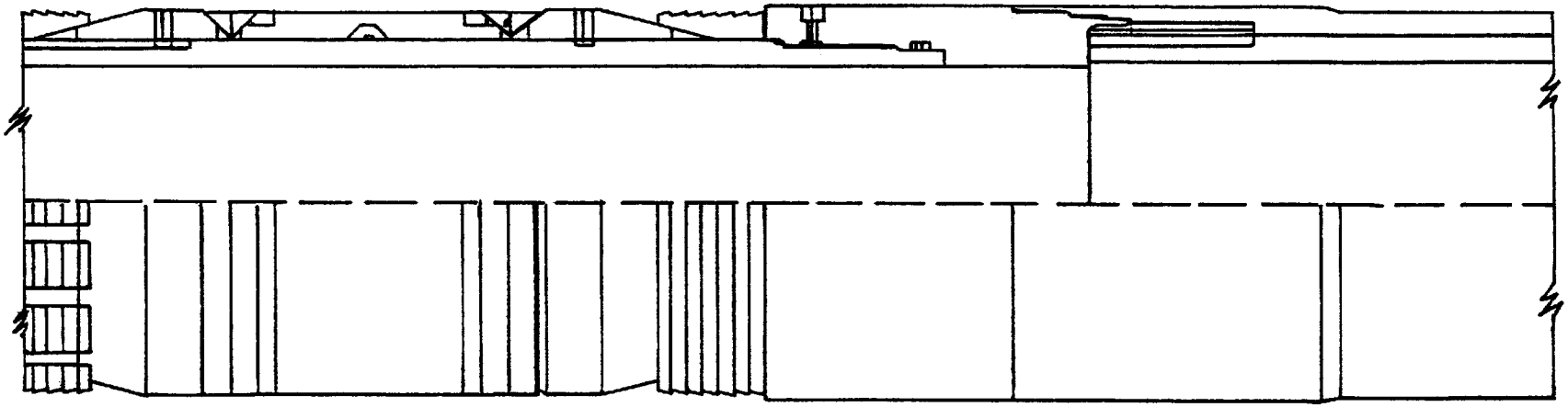
Figure 3D:
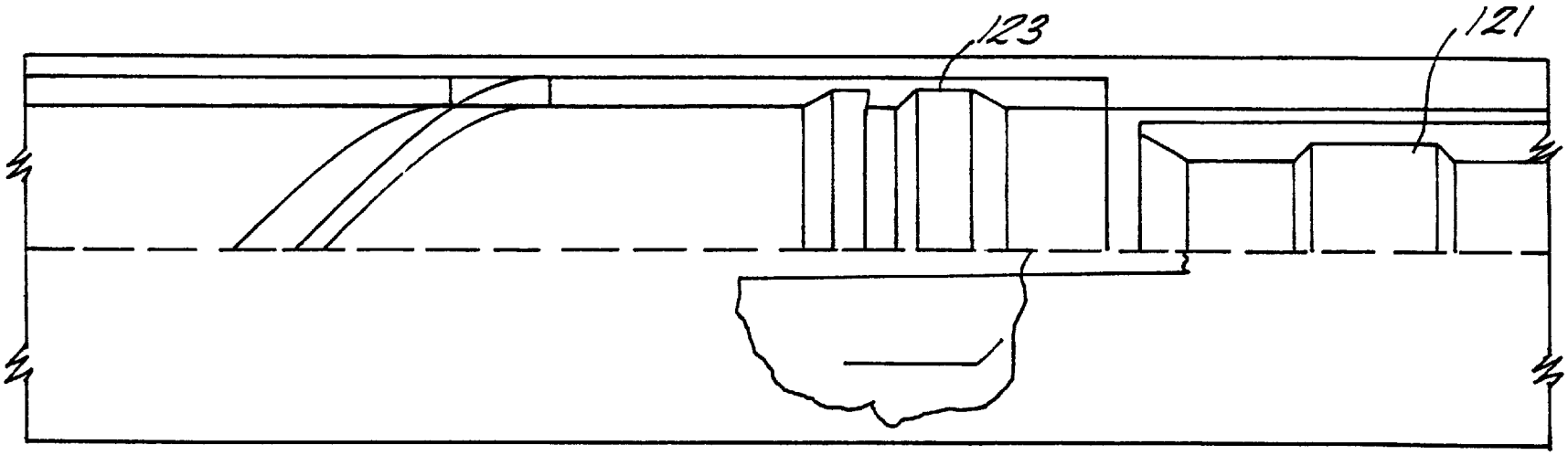
Figure 3E:
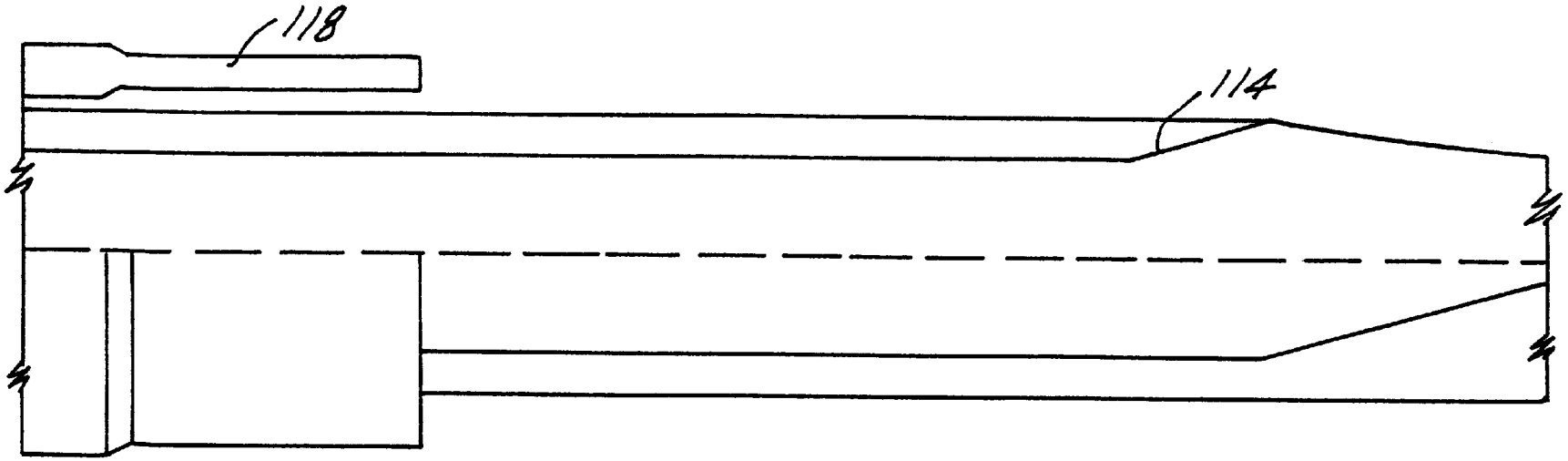
Figure 3F:
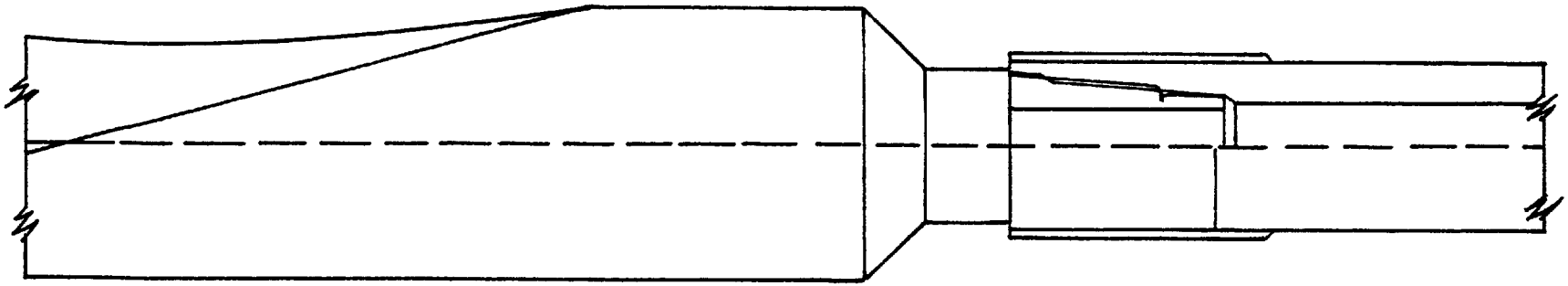
Figure 3G:
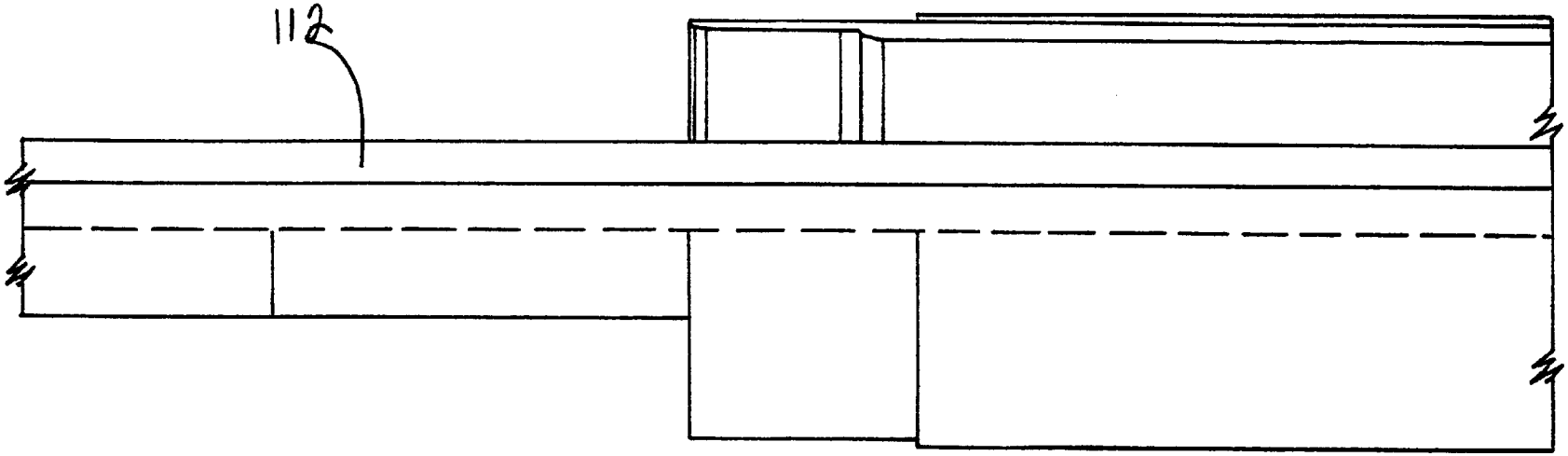
Figure 3H:
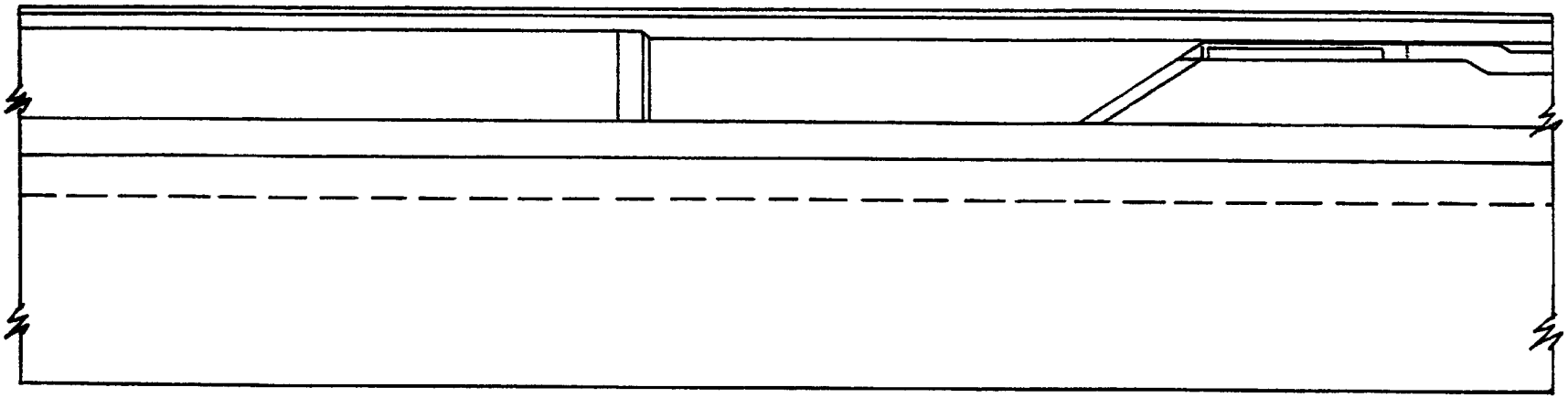
Figure 3J:
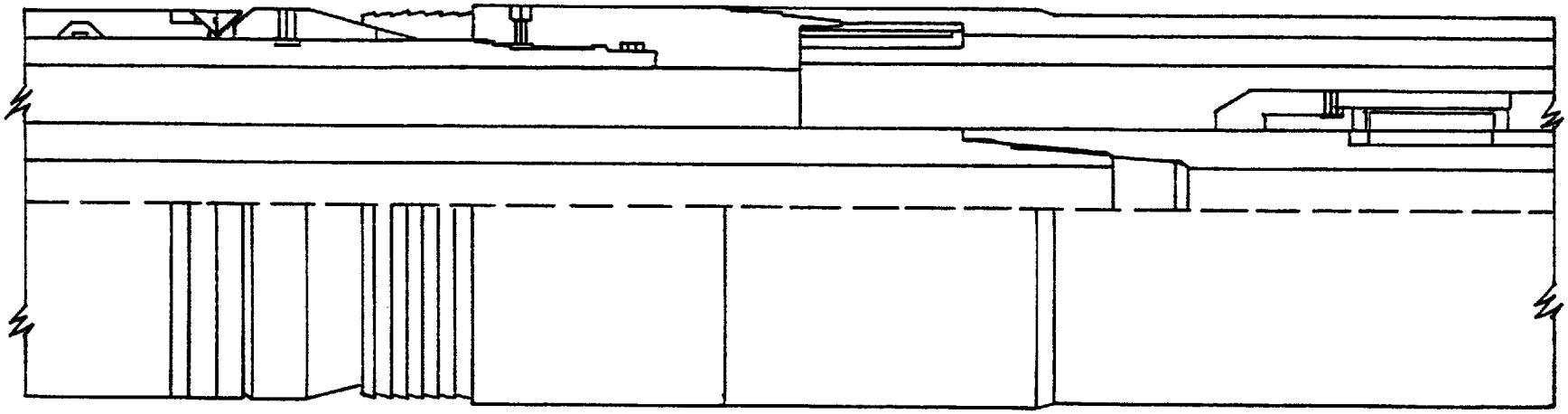
Figure 3K:
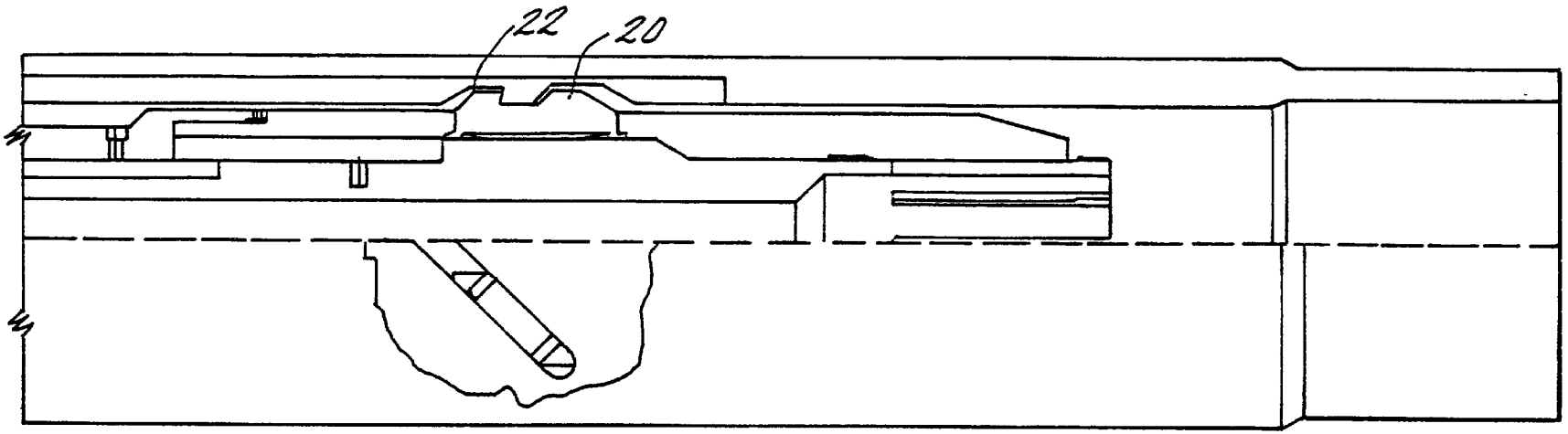

In a second embodiment of the invention, as illustrated in FIGS. 3A–3K, a tool not requiring a centralization stub with extendable arms is illustrated. It should be understood, however, that this tool is for use only with other tools with an outside dimension not greater than 4.75 inches and most preferably for tools having an outer dimension of three inches or less. This embodiment also depends upon packers downhole being close enough to allow the top of the guide stock to remain in the tail of the packer. Where these parameters are met, the need for the centralization sub is eliminated thus reducing cost of the apparatus. The guide stock is maintained in a centralized location by maintaining the top of the same within the bore of the packer next uphole in the bore. In FIG. 3K one will recognize the parts that are identical to the previous embodiment and they are numbered alike. Moving uphole, elements of the packer through which the device of the invention has been passed are illustrated in FIGS. 3G–3J. These are conventional elements and farther discussion thereof is not required. Beginning in FIG. 3G, a spacer tube 112 of the invention is illustrated with a break line to indicate that length has been deleted from the drawings. The purpose of spacer tube 112 is to provide sufficient length of the overall tool including the guide stock diverter 114, for the top of the guide stock to remain in the tail 118 of the packer next uphole from the engaged packer. This provides centralization of the diverter as indicated above. It will be noted that profile 123 did not match dog 20 and, therefore, the selective orientation portion of the invention passed by the packer first illustrated in FIG. 3A–3D. It is not until dogs 20 of the invention reach the bottom of the packer illustrated in FIG. 3K that the dogs may spring out and engage profile 22. In all other respects the second embodiment of the invention functions as does the first.

Retrieval of these tools is accomplished by running conventional fishing tools which engage latching profiles on the guide stocks of the tools of the invention. With respect to the six inch access embodiment, an overshot tool (available from Baker Oil tools) through the packer bore above the guide stock to latch onto a profile 65 cut on the O.D. of the guide stock. This is illustrated In FIG. 1B. As weight is taken uphole the collet 28 collapses allowing the mandrel 26 to move uphole and desupport the dogs 20, the dogs collapse. Upon further pulling uphole the centralizing arms are drawn back to their resting position by the garter spring 58. Projection 68 is then engaged by reverse angled section 66 which maintains the arms in the stowed position.

Retrieval of the second embodiment of the invention is very similar to the first however an external fishing neck tool is employed (available from Baker Oil Tools, Houston, Tex.) to engage an internal profile cut in the top of the guide stock. The profile is indicated at 121 in FIG. 3E.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A diverter system for intervention of a lateral borehole comprising:

a target packer, of one or more packers, having a 360° helical slot and a unique selective profile provided in an inner diameter of the target packer and wherein each of the one or more packers have different selective profiles;

an orientation sub having at least one collapsible key engageable with the 360° helical slot of the target packer and at least one profiled collapsible dog complementary to and engageable with only the selective profile of the target packer;

a guide stock attached to said orientation sub and having a diverter, adjustable relative to said orientation sub.

2. A diverter system as claimed in claim 1 wherein said profiled dog is machined to match the selective profile of said target packer and to skip past any nondesired packers in said borehole.

3. A diverter system as claimed in claim 2 wherein said at least one dog is positioned in said orientation sub so that when said key reaches a downhole end of the helical slot, said at least one dog is in a position to engage the matching selective profile in the inner diameter of the packer.

4. A diverter system as claimed in claim 1 wherein said at least one dog is a plurality of dogs all exhibiting an identical profile all of which are engageable with said selective profile.

5. A diverter system as claimed in claim 1 wherein said guide stock includes an extension adapted to reside in a tail section of a second packer in order to centralize said guide stock.

6. A diverter system for intervention of a lateral borehole comprising:

a packer, of one or more packers, having a helical slot and a selective profile provided in an inner diameter of the packer;

an orientation sub having at least one collapsible key engageable with the helical slot of the packer and at least one profiled collapsible dog engageable with the selective profile of the packer;

a guide stock attached to said orientation sub and having a diverter, adjustable relative to said orientation sub a centralization sub having a body section and a set of arms articulated at one end to the body section and free at the other end thereof, said body section further having an angled portion angled sufficiently to facilitate driving said free ends of said arms outwardly upon shortening of the guide stock.

7. A diverter system as claimed in claim 6 wherein said body section includes a shear pin preventing the shortening of the guide stock until a predetermined load is placed on the pin at which point the pin shears and allows the guide stock to shorten and drive the arms outwardly into contact with the borehole in which the system is disposed.

8. A diverter system as claimed in claim 6 wherein said arms further include angled end portions which when extended approximate a set of dimensions of the borehole in which the system is installed.

9. A diverter system as claimed in claim 6 wherein said body section includes a reverse angled section to maintain the arms in a stowed position during periods of disuse.

10. A diverter system as claimed in claim 9 wherein said arms are urged into the stowed position by a garter spring.

11. A diverter system as claimed in claim 1 wherein said guide stock includes a splined adjustment section to angularly orient the guide stock relative to the orientation sub.

12. A method for reentering a lateral borehole comprising:

running a reentry tool having at least one collapsible key engageable with a 360° helical slot in one or more packers in a borehole and at least one collapsible dog complementary to and engageable with only one of the one or more packers via a distinct selective profile in each said one or more packers;

orienting said reentry tool by following said slot with said key and engaging said specific profile with said at least one dog; and running a second tool into contact with a diverter of said reentry tool thereby deflecting said second tool into said lateral borehole.

* * * * *